US011591157B2

(12) United States Patent
Ishwait et al.

(10) Patent No.: US 11,591,157 B2
(45) Date of Patent: Feb. 28, 2023

(54) LIGHTNING PROTECTION SYSTEM FOR EXTERNAL FLOATING ROOF TANK

(71) Applicant: SAUDI ARABIAN OIL COMPANY, Dhahran (SA)

(72) Inventors: Basel A. Ishwait, Dhahran (SA); Rami M. O. Dabbousi, Dhahran (SA); Abdulwahab H. Alabdulwahab, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 216 days.

(21) Appl. No.: 16/930,436

(22) Filed: Jul. 16, 2020

(65) Prior Publication Data

US 2022/0017297 A1 Jan. 20, 2022

(51) Int. Cl.
*B65D 88/42* (2006.01)

(52) U.S. Cl.
CPC ..... *B65D 88/42* (2013.01)

(58) Field of Classification Search
CPC ..... B65D 90/511; B65D 90/26; B65D 90/22; B65D 88/48; B65D 88/44; B65D 88/38;
(Continued)

(56) References Cited

U.S. PATENT DOCUMENTS 2,936,925 A * 5/1960 Moyer ..... B65D 88/46 220/224
5,301,828 A 4/1994 McKay
(Continued)

FOREIGN PATENT DOCUMENTS

CN 104139931 A 11/2014
EP 0122591 A2 10/1984
(Continued)

OTHER PUBLICATIONS

Mohamed, F.M. and A.Y. Abdelaziz, "Protection of Floating Roof Petroleum Storage Tanks against Lightning Strokes", International Scholarly and Scientific Research & Innovation, World Academy of Science, Engineering and Technology International Journal of Electrical and Computer Engineering, vol. 11, No. 3, Jan. 2017, pp. 233-237 (5 pages).
(Continued)

*Primary Examiner* — Kareen K Thomas
(74) *Attorney, Agent, or Firm* — Osha Bergman Watanabe & Burton LLP

(57) ABSTRACT

A floating roof system with lightning protection includes a storage tank and a floating roof disposed inside the storage tank. A shoe seal is installed in sealing contact with an inner side wall surface of the storage tank. A primary seal extends between a rim of the floating roof and the shoe seal. A secondary seal extends over the primary seal and has an end in sealing contact with the inner side wall surface of the storage tank. Several shunts are distributed along a perimeter of the floating roof. The shunts extend over the primary seal and under the secondary seal. The shunts are attached to the primary seal and shoe seal by connections distributed along the shoe seal. The shunts are also attached to the primary seal, the secondary seal, and the rim of the floating roof by connections distributed along the rim.

19 Claims, 10 Drawing Sheets

(58) Field of Classification Search
CPC ..... B65D 88/36; B65D 81/245; B65D 88/42; B65D 88/40; B65D 88/50; B65D 88/46
See application file for complete search history.

(56) References Cited

U.S. PATENT DOCUMENTS

| | | | | |
|---|---|---|---|---|
| 5,667,091 | A | 9/1997 | Slaber, Jr. et al. | |
| 6,164,479 | A * | 12/2000 | Kern | B65D 88/46 220/216 |
| 6,247,607 | B1 * | 6/2001 | King | B65D 88/46 277/936 |
| 6,354,488 | B1 * | 3/2002 | Gallagher | B65D 88/46 220/221 |
| 2004/0112897 | A1 * | 6/2004 | Owens | B65D 88/46 220/224 |
| 2005/0072782 | A1 * | 4/2005 | Owens | B65D 88/46 220/224 |
| 2005/0098560 | A1 | 5/2005 | Hamer et al. | |
| 2007/0272692 | A1 | 11/2007 | Hiner | |
| 2013/0229744 | A1 * | 9/2013 | Rizk | H02H 1/04 361/220 |
| 2016/0244255 | A1 * | 8/2016 | Chynoweth | B65D 88/46 |
| 2021/0206563 | A1 * | 7/2021 | Pan | B65D 88/42 |

FOREIGN PATENT DOCUMENTS

| | | | |
|---|---|---|---|
| EP | 2966010 | A1 | 1/2016 |
| WO | 96/20886 | A1 | 7/1996 |

OTHER PUBLICATIONS

International Search Report and Written Opinion issued in Application No. PCT/US2020/044162, dated Apr. 26, 2021 (13 pages).

* cited by examiner

LIGHTNING PROTECTION SYSTEM FOR EXTERNAL FLOATING ROOF TANK

BACKGROUND

External floating roof tanks are commonly used to store crude and refined hydrocarbon products in hydrocarbon facilities. External floating roof tanks typically include an open top cylindrical shell and a roof that floats on the surface of the liquid contained within the shell. Floating roof tanks of the external type are open to the atmosphere. To avoid storage tank fires, these tanks are typically required to have protection against ignitions arising out of static, lightning, and stray electrical currents. Environmental regulations also require that seals are fitted between the shell and floating roof for emission control. The current standard is to install primary and secondary seals at the interface between the roof and the shell. The American Petroleum Institute, under API RP 545 standard, recommends installing submerged shunts between the roof and shell every 3 meters around the roof perimeter and installing bypass conductors between the roof and shell no more than every 30 meters around the circumference of the tank. The submerged shunts and bypass conductors are meant to target different components of a lightning strike current. However, submerged shunts and bypass conductors are difficult to install, inspect, and maintain.

SUMMARY

In a first summary example, an external floating roof tank with lightning protection includes a storage tank having an inner side wall surface and a floating roof having a rim. The floating roof is disposed within the storage tank and separated from the inner side wall surface by an annular gap. A shoe seal is disposed inside the storage tank and in sealing contact with the inner side wall surface. A primary seal extends between the rim and the shoe seal. The primary seal has a first end proximate to the shoe seal and a second proximate to the rim. A secondary seal extends over the primary seal. The secondary seal has a first end in sealing contact with the inner side wall surface of the storage tank and a second end proximate to the rim of the floating roof. A plurality of shunts extend over the primary seal and under the secondary seal. The plurality of shunts are distributed along a perimeter of the floating roof. The plurality of shunts have first ends proximate to the shoe seal and second ends proximate to the rim. The first end of the primary seal and the first ends of the shunts are attached to the shoe seal by a plurality of first connections. The second end of the primary seal, the second end of the secondary seal, and the second ends of the plurality of shunts are attached to the rim of the floating roof by a plurality of second connections.

The first end of the secondary seal may include a wiper seal. Each of the plurality of shunts may include a flat strap conductor or a bare conductor with lugs made of electrically conductive material. A plurality of shoe hangers may be attached between the shoe seal and the rim. Each of the plurality of shoe hangers applies a force to the shoe seal to maintain the sealing contact between the shoe seal and the inner side wall surface of the storage tank. A circumferential spacing between the plurality of shunts may be approximately 3 meters.

Each of the first connections may include one of a plurality of apertures formed in the shoe seal, one of a plurality of apertures formed in the first end of the primary seal, and an aperture formed in the first end of one of the shunts. Each of the first connections may include a first bolt inserted through the respective apertures at the first connection. Each of the first connections may include a first double lock nut placed on the first bolt and tightened with a required torque for a selected size of the first bolt. Portions of the first end of the primary seal, the shoe seal, and the first end of one of the shunts are compressed between a head of the bolt and the first double lock nut. Each of the first connections may include a first set of washers placed on the first bolt and interposed between the head of the first bolt and the shoe seal and a second set of washers placed on the first bolt and interposed between the shunt and the first double lock nut. Each of the first and second sets of washers may include a flat washer and a lock washer.

Each of the second connections may include one of a plurality of apertures formed in the rim, one of a plurality of apertures formed in the second end of the primary seal, one of a plurality of apertures formed in the second end of the secondary seal, and an aperture formed in the second end of one of the shunts. Each of the second connections may include a second bolt inserted through the apertures at the second connection. Each of the second connections may include a second double lock nut placed on the second bolt and tightened with a required torque for a selected size of the second bolt. Portions of the second end of the primary seal, the rim, the second end of the secondary seal, and the second end of one of the shunts are compressed between a head of the second bolt and the second double lock nut. Each of the second connections may include a first set of washers placed on the second bolt and interposed between the head of the second bolt and the primary seal and a second set of washers placed on the second bolt and interposed between the secondary seal and the second double lock nut. Each of the first and second sets of washers may include a flat washer and a lock washer.

In a second summary example, a lightning protection system for an external floating roof tank includes a primary seal and a secondary seal. The primary seal has a first end with a plurality of first apertures and a second end with a plurality of second apertures. The secondary seal extends over the primary seal and has a first end including a wiper seal and a second end with a plurality of apertures. The system includes a plurality of shunts extending over the primary seal and under the secondary seal. Each of the plurality of shunts has a first end with a first aperture and a second end with a second aperture. The system includes a plurality of first connections engageable with the first apertures in the first end of the primary seal and the first apertures in the first ends of the plurality of shunts. The plurality of first connections attach the plurality of shunts to the primary seal at spaced apart locations along the primary seal. The system includes a plurality of second connections engageable with the second apertures in second end of the primary seal, the apertures in the second end of the secondary seal, and the second apertures in the second ends of the plurality of shunts. The plurality of second connections attach the shunts to the primary seal and secondary seal at spaced apart locations along the primary seal and the secondary seal.

Each of the plurality of shunts may include a flat strap conductor or a bare conductor with lugs made of electrically conductive material.

Each of the first connections may include a first bolt that is insertable through one of the first apertures of the primary seal that is aligned with the first aperture of one of the shunts. Each of the first connections may include a first double lock nut that is placeable on the first bolt. The first double lock nut is to be tightened with a required torque for a selected size of the first bolt to secure the first connection. Each of the first connections may include a first set of washers placeable on the first bolt and a second set of washers placeable on the first bolt. The first and second sets of washers may include a flat washer and a lock washer.

Each of the second connections may include a second bolt that is insertable through one of the second apertures of the primary seal that is aligned with the second aperture of one of the shunts and one of the apertures of the secondary seal. Each of the second connections may include a second double lock nut that is placeable on the second bolt. The second double lock nut is to be tightened with a required torque for a selected size of the second bolt to secure the second connection. Each of the second connections may include a first set of washers placeable on the second bolt and a second set of washers placeable on the second bolt. Each of the first and second sets of washers may include a flat washer and a lock washer.

In a third summary example, a method of assembling a floating roof tank includes disposing a floating roof in a storage tank, mounting a shoe seal in the storage tank in sealing contact with an inner side wall surface of the storage tank, disposing a primary seal around a perimeter of the floating roof and in an annular gap between the shoe seal and the floating roof, disposing a secondary seal above the primary seal, and disposing a plurality of shunts between the primary seal and the secondary seal and distributing the plurality of shunts along the perimeter of the floating roof. The first ends of the plurality of shunts are attached to a first end of the primary seal and the shoe seal by a plurality of first fastener connections spaced apart along the shoe seal. The second ends of the plurality of shunts are attached to a second end of the primary seal, an end of the secondary seal, and the floating roof by a plurality of second fastener connections spaced apart along the perimeter of the floating roof.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
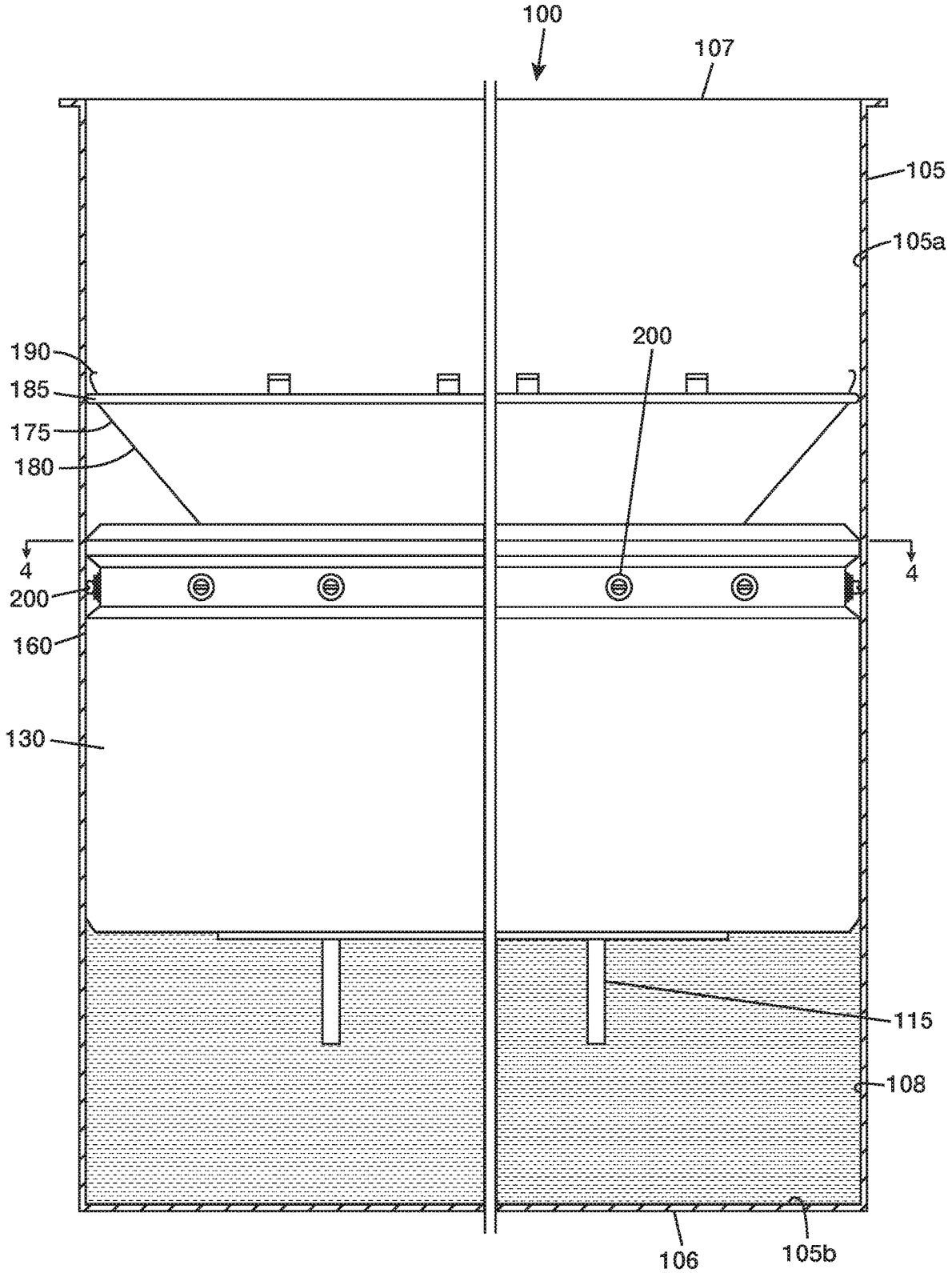
FIG. 1 is a cross-sectional view of a floating roof tank.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

Figure 2:
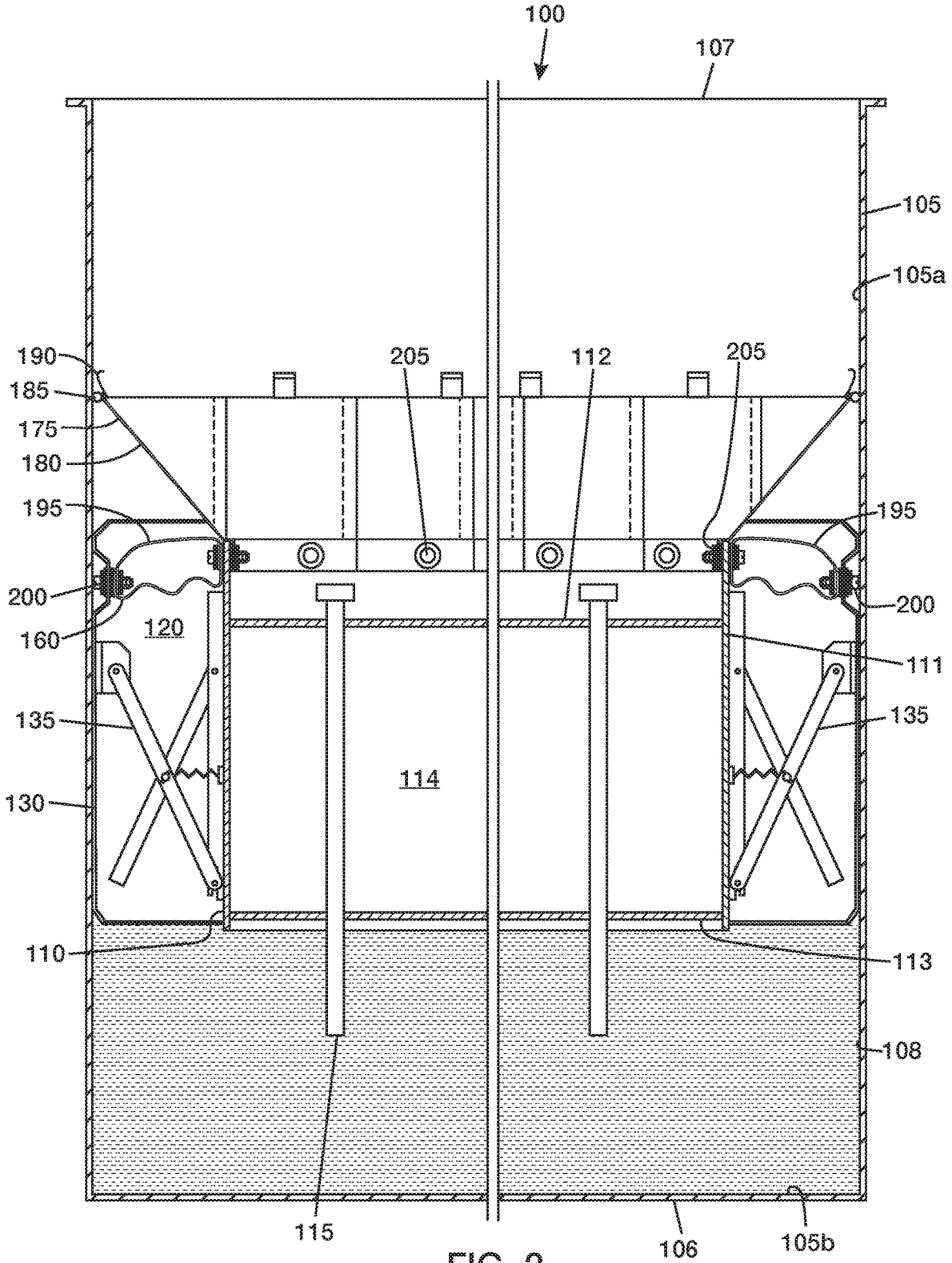
FIG. 2 is another cross-sectional view of the floating roof tank of FIG. 1.

FIGS. 1 and 2 show a floating roof tank 100 according to one illustrative implementation. Floating roof tank 100 includes a storage tank 105 having a closed bottom end 106 and an open top end 107. Storage tank 105 includes an inner side wall surface 105*a* and an inner bottom wall surface 105*b* defining a chamber 108 to hold a liquid product. In some cases, the liquid product may be oil or another hydrocarbon product. Inner side wall surface 105*a* may be a cylindrical surface. Inner bottom wall surface 105*b* may be a planar surface as illustrated or may be a different type of surface, such as a dome-shaped surface. Storage tank 105 may be made of metal or alloy. Preferably, the material of storage tank 105 is corrosion-resistant and appropriate for the liquid product to be stored in chamber 108. In some cases, storage tank 105 may be made of steel as specified by API 650 (a standard by the American Petroleum Institute (API) governing welded tanks for oil storage) and API 620 (a standard by the API governing design and construction of large, welded, low-pressure storage tanks).

A floating roof 110 (in FIG. 2) is disposed within storage tank 105. Floating roof 110 floats on top of the liquid product inside storage tank 105, rising and falling with the level of the liquid product in storage tank 105. In one example, floating roof 110 has a rim (or side wall) 111. Floating roof 110 has a top deck (or top wall) 112. Floating roof 110 may have a bottom deck (or bottom wall) 113 disposed below top deck 112. Rim 111 surrounds and is attached to the edges of top deck 112 and bottom deck 113. Floating roof 110 is illustrated as a double-deck roof. In an alternative implementation, floating roof 110 may be a single deck roof or pontoon roof. In the illustrated floating roof 110, a space 114 is formed between top deck 112 and bottom deck 113. Space 114 may be filled with air. Space 114 may contain bulkheads (not shown). Floating roof 110 may have support legs 115 hanging below bottom deck 113. Support legs 115 may extend from above top deck 112 to below bottom deck 113 through space 114. As shown, support legs 115 are buoyant. When there is no liquid product in chamber 108, or when the volume of the liquid product in chamber 108 is low, support legs 115 may rest on inner bottom wall surface 105*b*, keeping deck 113 at some minimum height above inner bottom wall surface 105*b*. An outer diameter of floating roof 110 is smaller than an inner diameter of storage tank 105 such that an annular gap 120 is defined between inner side wall surface 105*a* and rim 111.

A shoe seal 130 is disposed inside storage tank 105 and in contact with inner side wall surface 105*a*. Shoe seal 130 is slidable up and down inner side wall surface 105*a*. Shoe seal 130 may be made of a series of plates joined together to form a ring. Shoe seal 130 may be made of a corrosion-resistant metal or alloy, such as stainless or galvanized steel, or other material that can make a sealing contact with the material of inner side wall surface 105*a*. Shoe seal 130 is supported in annular gap 120 by a plurality of shoe hangers 135 arranged along the perimeter of floating roof 110, or along rim 111. Each shoe hanger 135 is coupled to shoe seal 130 and rim 111. As shown more clearly in FIG. 3, each shoe hanger 135 may include a pair of arms 140, 145 connected at the middle with a movable joint 150, which in one example may be a pivoting and sliding joint. In one example, arm 140 is coupled to rim 111 of floating roof 110 with a sliding joint 141 and to shoe seal 130 with a pivoting joint 142, and arm 145 is coupled to rim 111 of floating roof 110 with a pivoting joint 146. A spring 155 is connected between floating roof 110 and movable joint 150. Instead of spring 155, a counterweight may be attached to arm 145. Spring 155 (or counterweight attached to arm 145) creates a biasing force on movable joint 150 that ultimately pushes shoe seal 130 into sealing contact with inner side wall surface 105*a* of storage tank 105. This type of shoe hanger is known as a scissor-type hanger or pantograph. Other shoe hangers or pantographs or pusher mechanisms are known in the art and may be used in place of the illustrated shoe hanger to support shoe seal 130 in sealing contact with inner side wall surface 105*a*.

Figure 3:
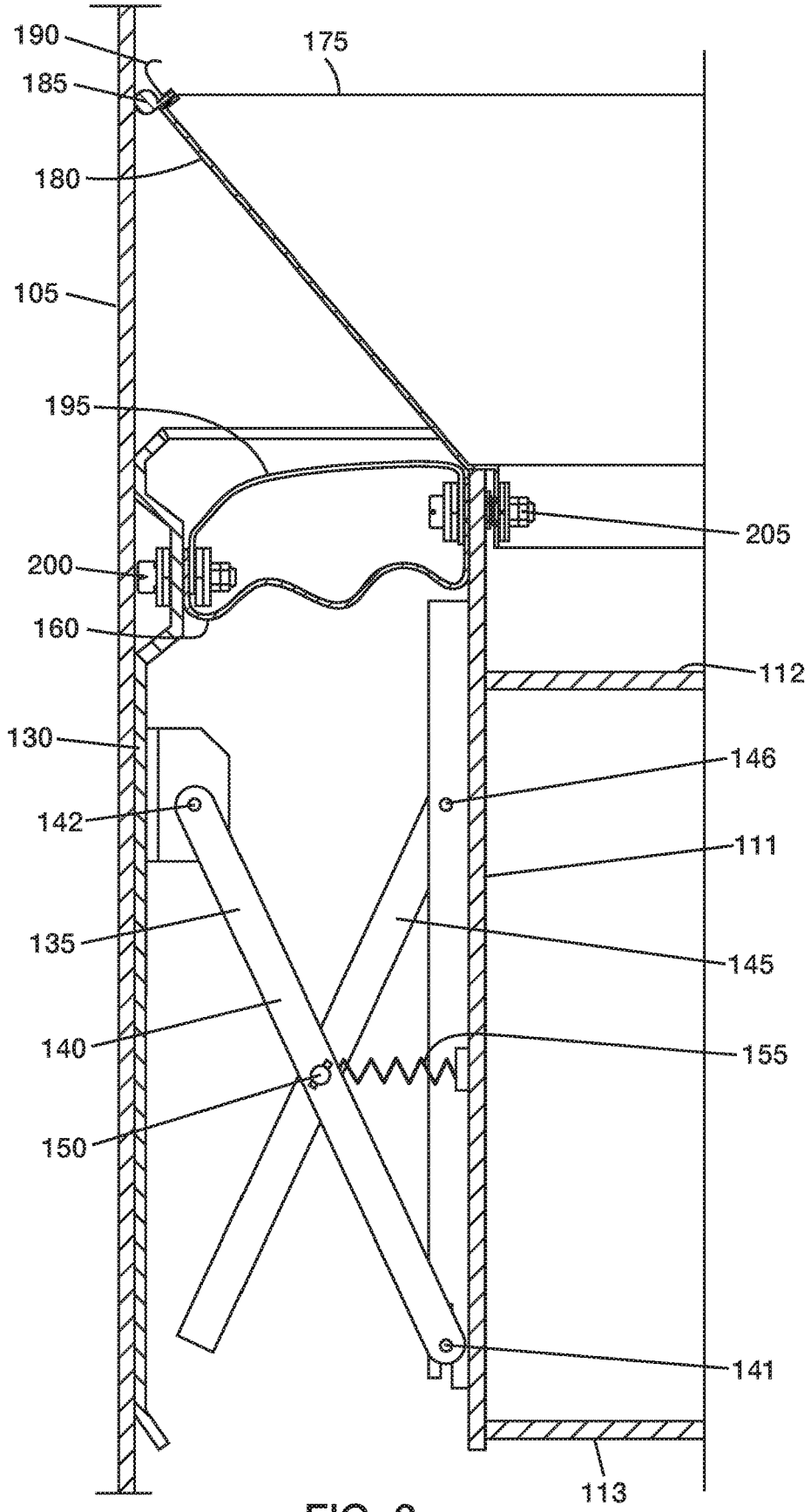
FIG. 3 is an enlargement of a portion of the cross-sectional view shown in FIG. 2.
Figure 4:
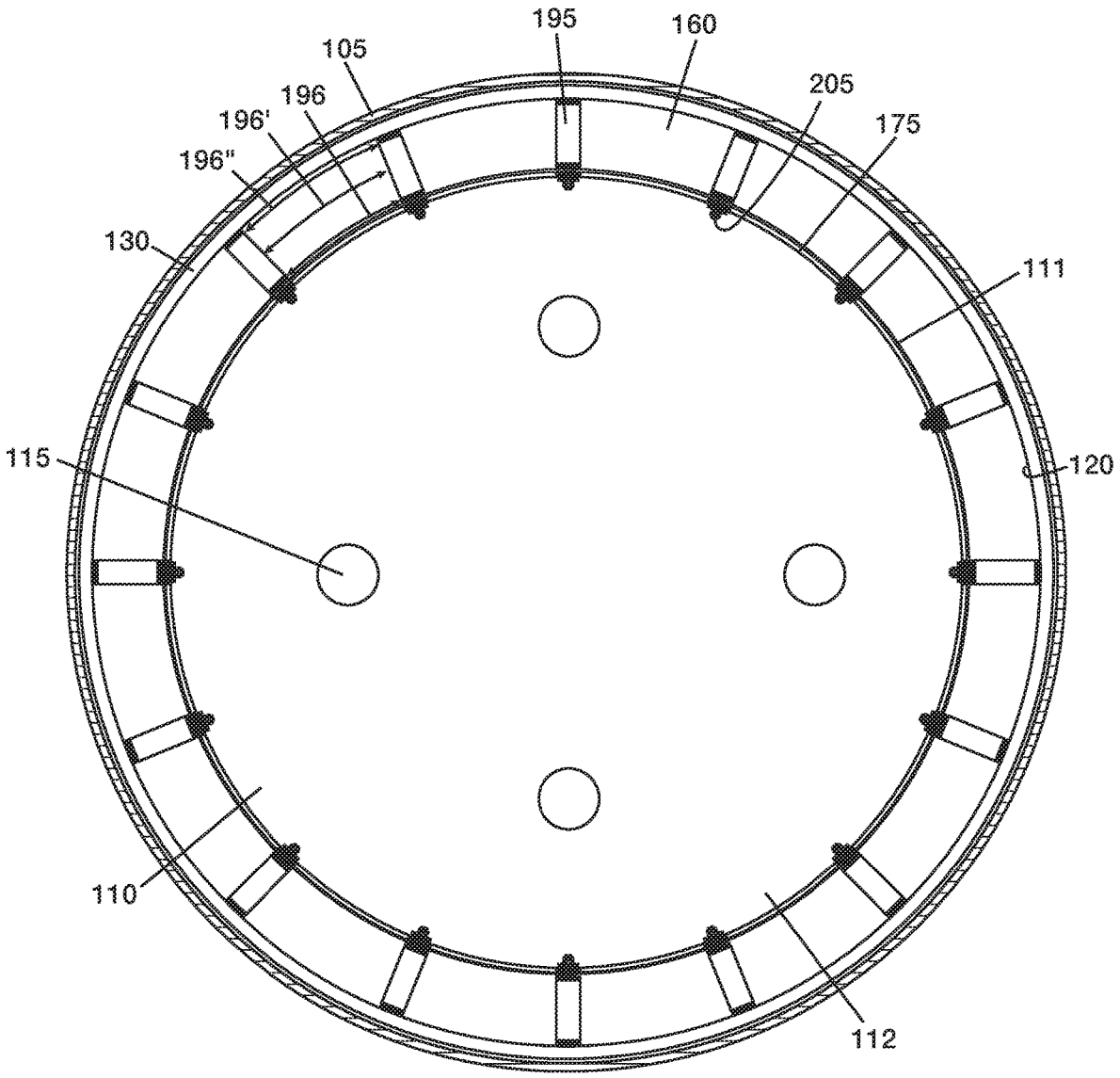
FIG. 4 is a cross-sectional view of the floating roof tank of FIG. 1 along line 4-4.

Returning to FIG. 2, a primary seal 160 extends between shoe seal 130 and rim 111 and circumscribes rim 111, i.e., primary seal 160 is annular in shape. In the illustrated example, primary seal 160 is located above shoe hangers 135. Primary seal 160 may be a water-resistant fabric or flexible material that acts as a barrier to vapors produced from hydrocarbons. Primary seal 160 may be made of, for example, polytetrafluoroethylene (PTFE) or polyurethane. Primary seal 160 and shoe seal 130 form a primary sealing system that may perform functions such as minimizing vapor loss from floating roof tank 100, centralizing floating roof 110 within storage tank 105, and preventing atmospheric materials, such as snow and rain, from contaminating the liquid product inside storage tank 105. An outer end of primary seal 160 (i.e., the end proximate to shoe seal 130) is attached to shoe seal 130 at a plurality of locations by connections 200 (also shown in FIGS. 1 and 3). Connections 200 are distributed along a circumference of shoe seal 130. An inner end of primary seal 160 (i.e., the end proximate to rim 111) is attached to rim 111 at a plurality of locations by connections 205 (also shown in FIG. 3). Connections 205 are spaced apart along a circumference of rim 111. FIG. 4 shows connections 205 distributed along a circumference of rim 111 (a similar distribution exists for connections 200 at shoe seal 130). In one implementation, connections 200, 205 are fastener connections, e.g., bolted connections.

Returning to FIG. 2, a secondary seal 175 extends over primary seal 160 and forms an additional sealing barrier over the sealing barrier formed by primary seal 160 and shoe seal 130. Secondary seal 175 may include a support plate 180, which may be in the form of a tapered ring. Support plate 180 may be made of overlapping plate sections that are joined together to form the tapered ring. The plate sections may be made of metal or alloy, such as steel. An outer end of support plate 180 carries a wiper seal 185, which is positioned in sealing contact with inner side wall surface 105*a*. Wiper seal 185 is ring shaped and forms a circumferential seal with inner side wall surface 105*a*. Wiper seal 185 may include a foam material, such as a polyurethane foam material, enclosed in a sealing envelope. Wiper seal 185 is shown as having a round tip for sealing contact with inner side wall surface 105*a*. However, secondary seal 175 is not limited to this particular type of wiper seal. For example, a wiper seal having a single blade tip or double blade tip may be used. Secondary seal 175 moves up and down as floating roof 110 moves up and down. Skid plates 190 arranged along the top edge of secondary seal 175 may guide the up and down motion of secondary seal 175. Skid plates 190 are spaced from inner side wall surface 105*a* and do not form a sealing contact with inner side wall surface 105*a*. Skid plates 190 may be made of metal or alloy, such as stainless steel. An inner end of secondary seal 175 (i.e., the end proximate to rim 111) is attached to rim 111 at a plurality of locations by the same connections 205 that attach primary seal 160 to rim 111.

Figure 5A:
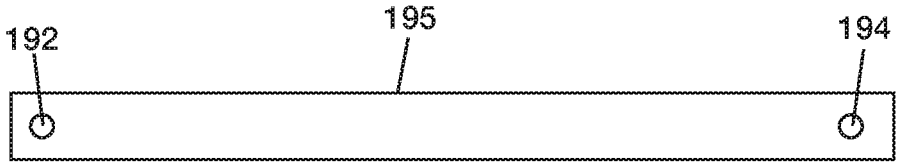
FIG. 5A is a schematic diagram of a shunt including a flat strap conductor.
Figure 5B:
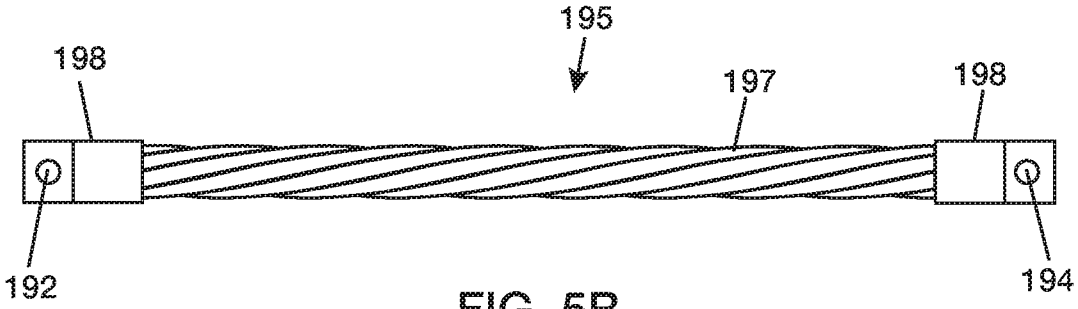
FIG. 5B is a schematic diagram of a shunt including a bare conductor with lugs.

A lightning protection is incorporated into the sealing system provided by shoe seal 130, primary seal 160, and secondary seal 175. In one implementation, the lightning protection includes a plurality of shunts 195 mounted in annular gap 120. Shunts 195 extend over primary seal 160 and under secondary seal 175, i.e., shunts 195 are located between primary seal 160 and secondary seal 175. Shunts 195 are distributed along the perimeter of floating roof 110, or along a circumference of rim 111, as best shown in FIG. 4. Preferably, there is a shunt at every location where primary seal 160 is attached to shoe seal 130 to allow optimal dissipation of electrical current during lightning strike. Preferably, shunts 195 are evenly spaced around the perimeter of floating roof 110. In some cases, a circumferential spacing between shunts 195 may be in a range from 2.8 meters to 3.2 meters, or about 3 meters. The circumferential spacing may be measured along rim 111 (as shown at 196 in FIG. 4) or along shoe seal 130 (as shown at 196" in FIG. 4) or along some position between rim 111 and shoe seal 130 (as shown at 196' in FIG. 4). Each shunt 195 is made of electrically conductive material. As illustrated in FIG. 5A, each shunt 195 may be a flat strap conductor. The flat strap may be bent to extend over primary seal 160 as shown in FIGS. 2 and 3. Alternatively, as shown in FIG. 5B, each shunt 195 may include a bare conductor 197 (stranded, as shown, or solid) with ends fitted in lugs 198 made of electrically conductive material. Preferably, the electrically conductive material of the conductors and lugs is corrosion-resistant. Examples of suitable materials for the shunt include, but are not limited to, stainless steel, copper, aluminum, tinned copper, and bronze. Each shunt 195 may have a width (or diameter) in a range from 40 mm to 60 mm, or a width (or diameter) of about 50 mm. The length of shunt 195 will be dictated by the radial distance between rim 111 and shoe seal 130. With the flat strap conductor, the thickness of shunt 195 may be a minimum of 0.4 mm. With the bare conductor, the cross-sectional area of shunt 195 may be a minimum of 25 $mm^2$. A shown in FIGS. 2 and 3, at one end, shunts 195 are attached to primary seal 160 and shoe seal 130 by the same connections 200 that attach primary seal 160 to shoe seal 130. At the other end, shunts 195 are attached to primary seal 160, secondary seal 175, and rim 111 by the same connections 205 that attach primary seal 160 and secondary seal 175 to rim 111.

Figure 6:
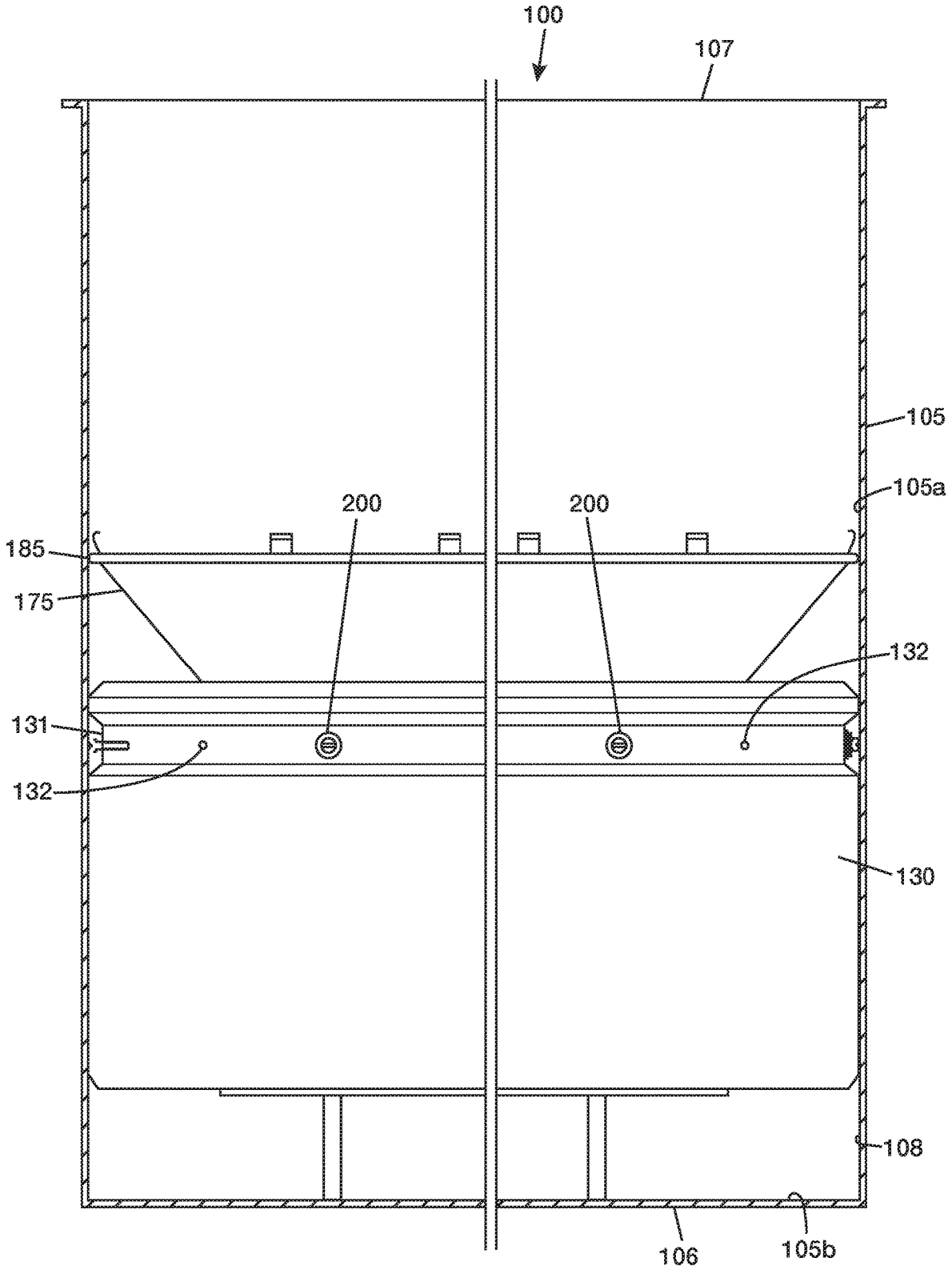
FIG. 6 is another cross-sectional view of the floating roof tank of FIG. 1 illustrating apertures in a shoe seal.
Figure 7:
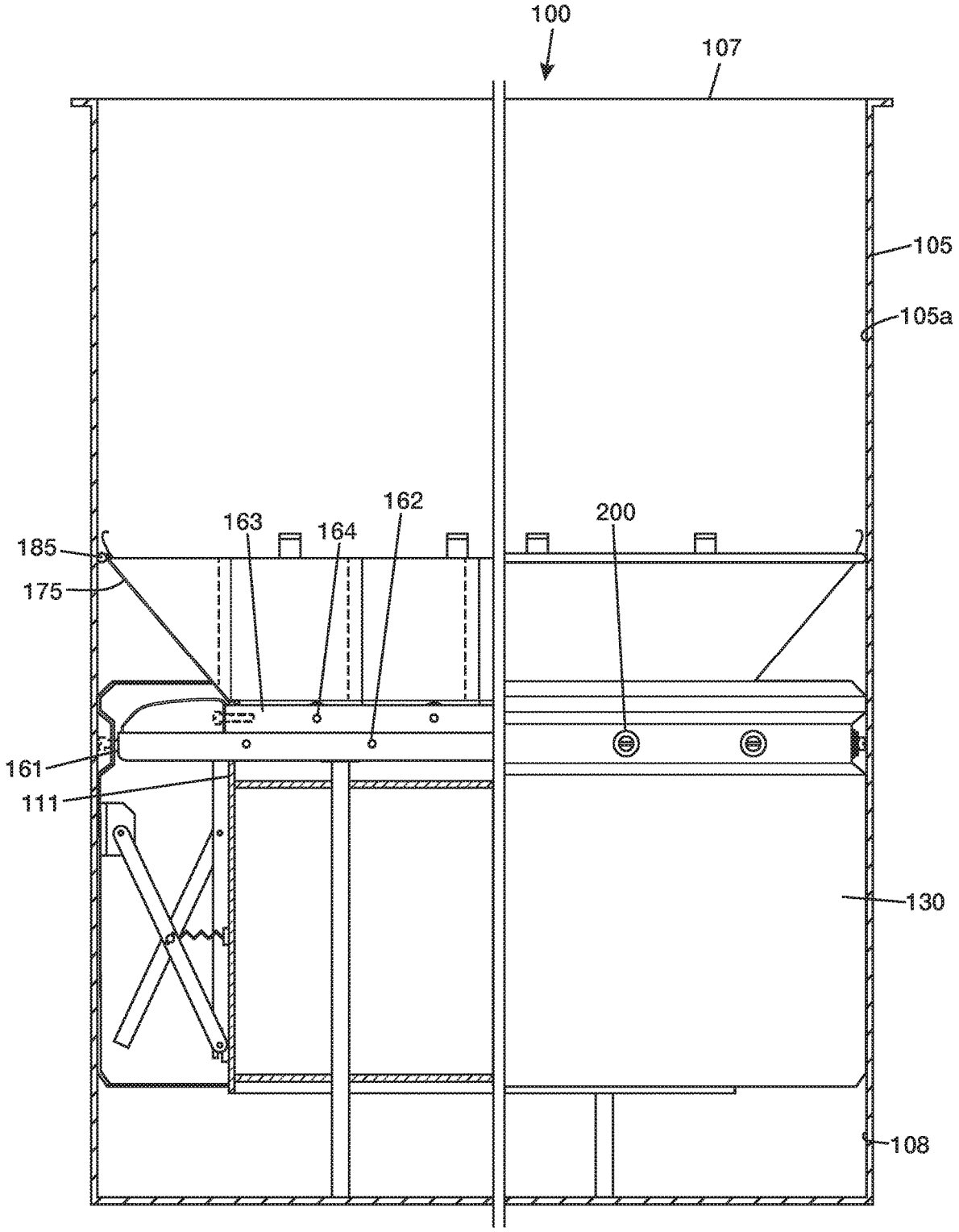
FIG. 7 is another cross-sectional view of the floating roof tank of FIG. 1 illustrating apertures in a primary seal.
Figure 8:
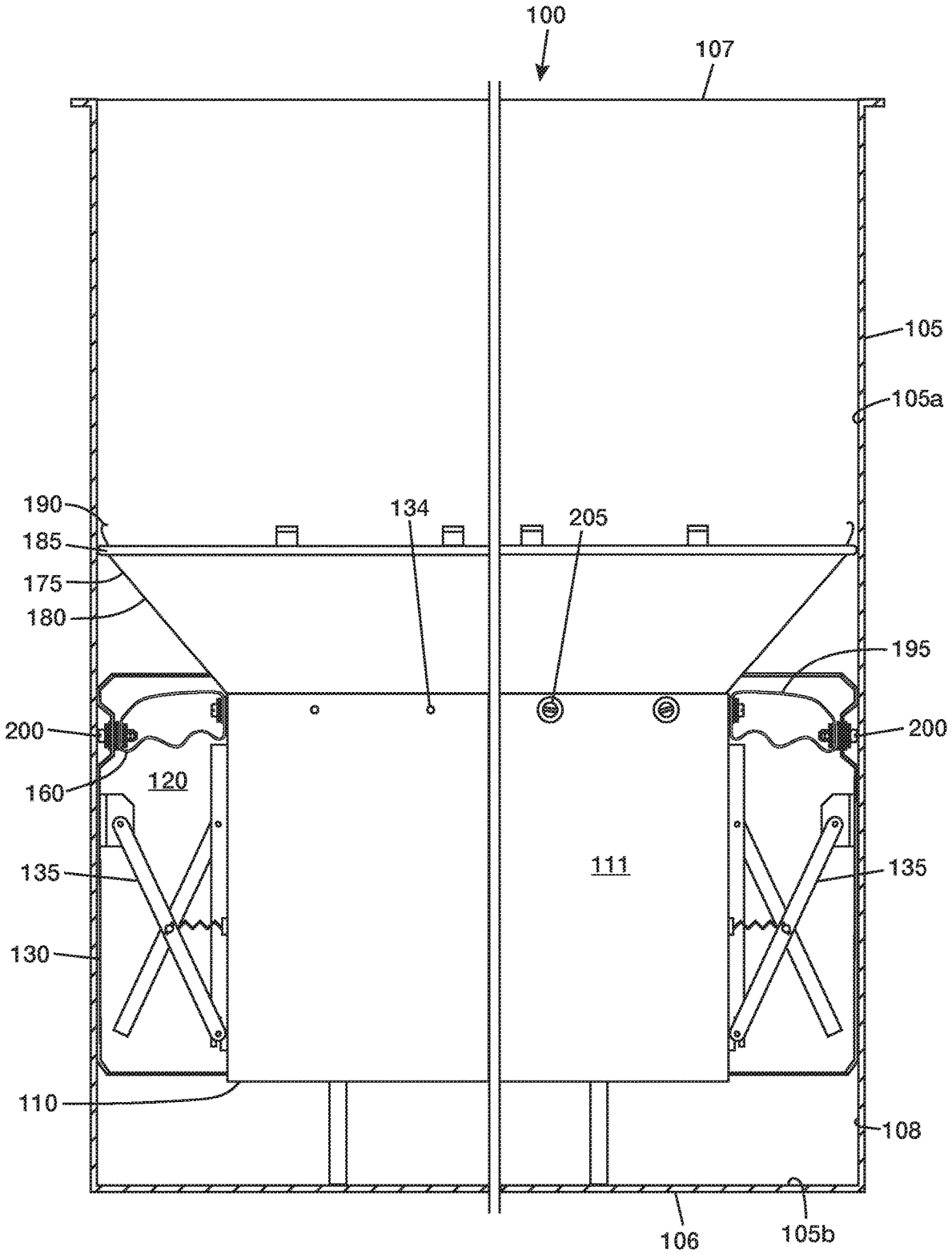
FIG. 8 is another cross-sectional view of the floating rook tank of FIG. 1 illustrating apertures in a floating roof rim.
Figure 9:
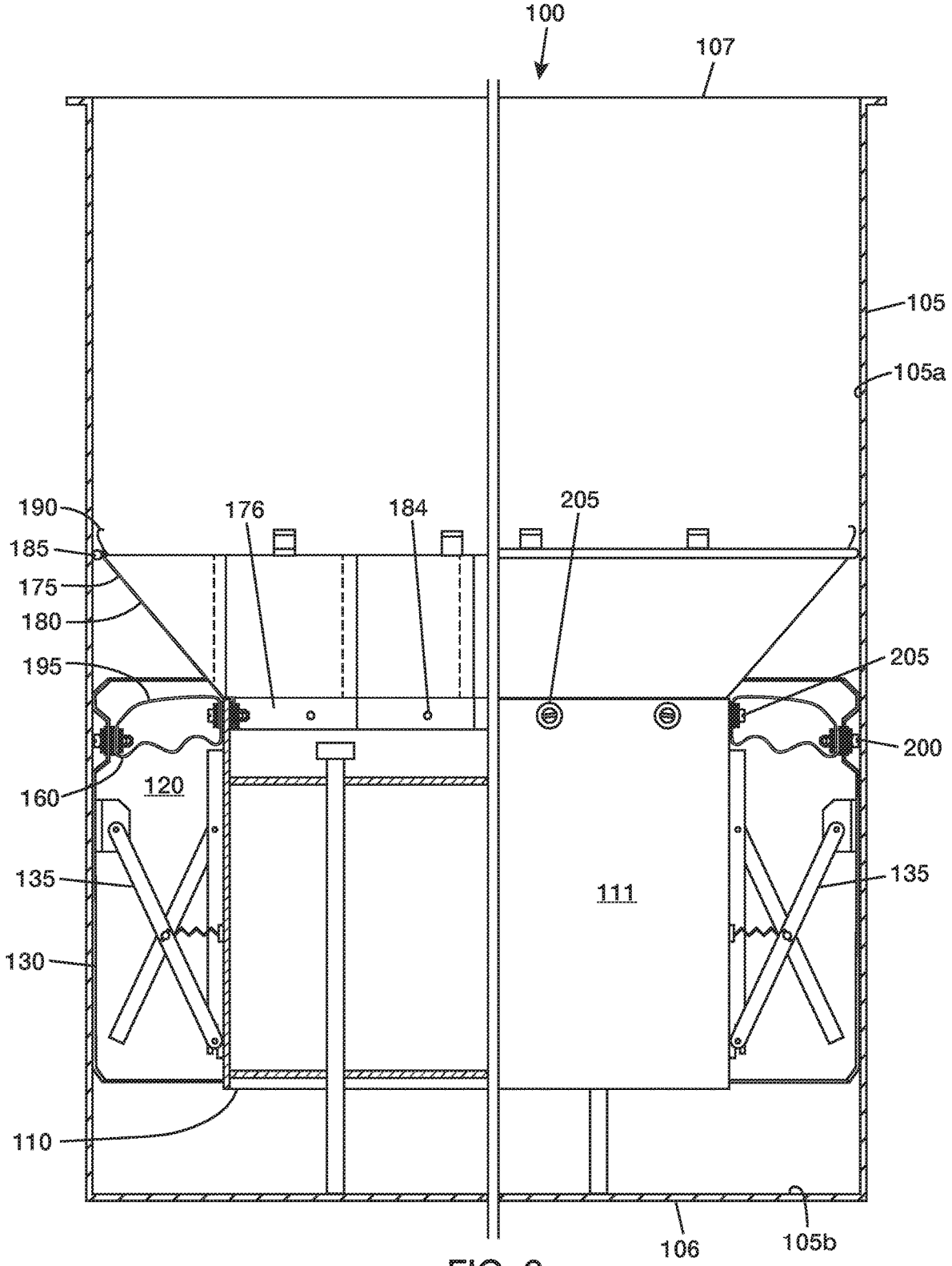
FIG. 9 is another cross-sectional view of the floating roof tank of FIG. 1 illustrating apertures in a secondary seal.

For making connections 200, 205, shoe seal 130, shunts 195, primary seal 160, secondary seal 175, and rim 111 include apertures to receive fasteners. As illustrated in FIG. 6, a region 131 of shoe seal 130 where connections 200 are made includes a plurality of apertures 132 that are spaced apart along a circumference of the shoe seal. As illustrated in FIG. 7, an outer end 161 of primary seal 160 where connections 200 are made includes a plurality of apertures 162 that are spaced apart along a circumference of the primary seal. Also, as shown in FIG. 7, an inner end 163 of primary seal 160 where connections 205 are formed includes a plurality of apertures 164 that are spaced apart along a circumference of the primary seal. As illustrated in FIG. 8, a circumferential region of rim 111 where connections 205 are made includes apertures 134 that are spaced apart along the circumferential region. As illustrated in FIG. 9, an inner end 176 of secondary seal 175 where connections 205 are made includes a plurality of apertures 184 that are spaced apart along a circumference of the secondary seal. Finally, as shown in FIGS. 5A and 5B, each shunt 195 has apertures 192, 194 at opposite ends. Apertures 192 (in FIGS. 5A and 5B), 132 (in FIG. 6), and 162 (in FIG. 7) are aligned at each connection 200 to receive a fastener. Similarly, apertures 194 (in FIGS. 5A and 5B), 134 (in FIG. 8), 164 (in FIG. 7), and 184 (in FIG. 9) are aligned at each connection 205 to receive a fastener.

Figure 10:
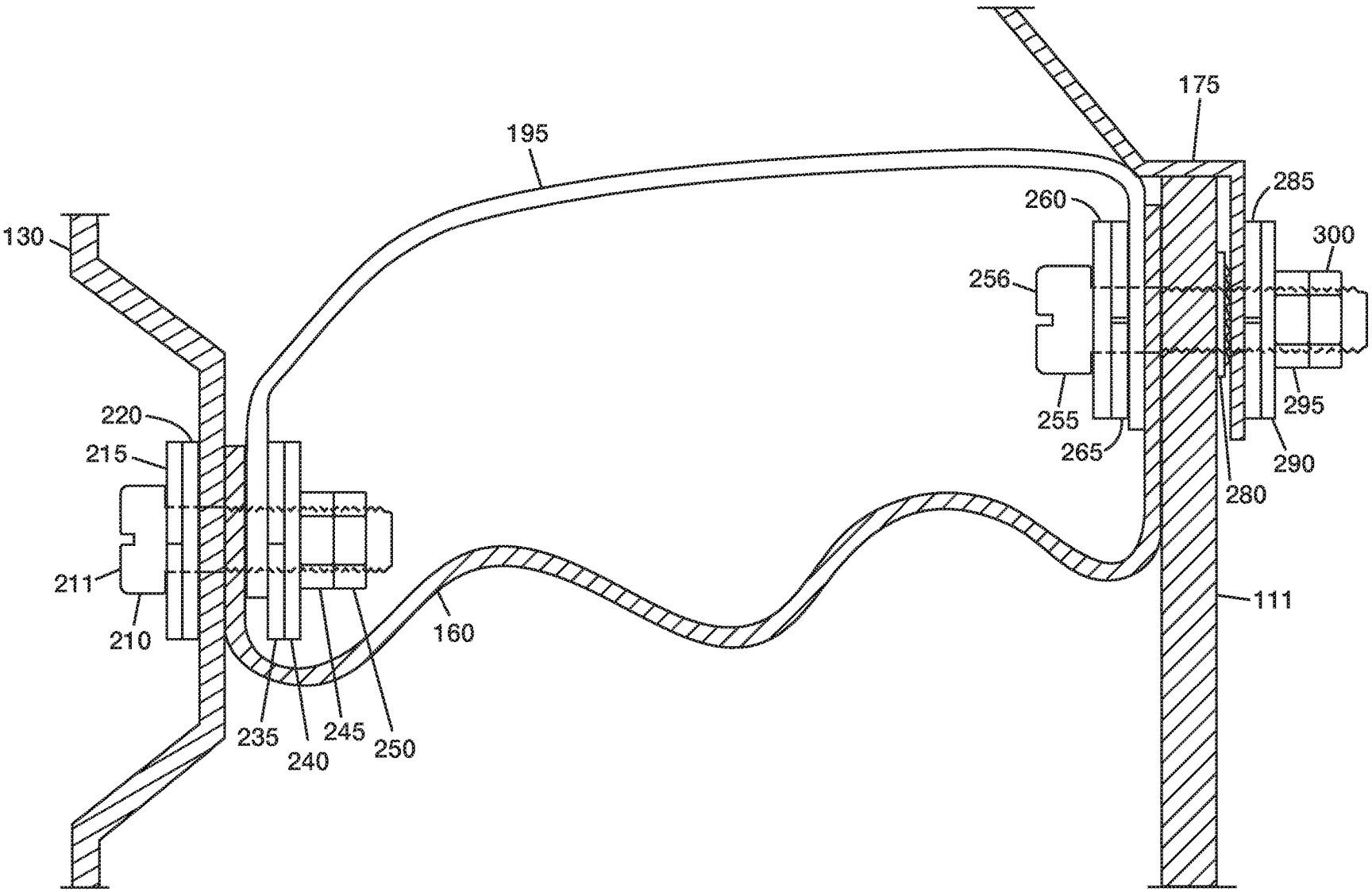
FIG. 10 is an enlargement of a portion of the cross-sectional view shown in FIG. 2 illustrating connections in the floating roof tank.

FIG. 10 shows example implementations of connections 200, 205. In the example of FIG. 10, each connection 200 includes a bolt 210, a flat washer 215, a lock washer (or spring washer) 220, a lock washer 235, a flat washer 240, and two lock nuts 245, 250 forming a double lock nut. Bolt 210 extends through aligned apertures in shoe seal 130, primary seal 160, and shunt 195. Washers 215, 220, 235, 240 are placed on bolt 210 as shown. Washers 215, 220, 235, 240 may be metal washers. The order of flat washer 215 and lock washer 220 may be reversed, i.e., lock washer 220 may be closer to bolt head 211 compared to flat washer 215. Similarly, the order of lock washer 235 and flat washer 240 may be reversed. In the example connection 200, flat washer 215 and lock washer 220 are interposed between shoe seal 130 and bolt head 211. Flat washer 240 and lock washer 235 are interposed between shunt 195 and lock nut 245. Shunt 195 may be in contact with primary seal 130 at connection 200 as shown. Connection 200 is secured by placing lock nuts 245, 250 on bolt 210 and tightening lock nut 250 against lock nut 245 with the required torque for the selected bolt size, preferably applied with a hydraulic torque wrench. With lock nut 250 tightened, all the elements between bolt head 211 and lock nut 250 are compressed together in a secure connection. Connection 200 may include other fastener elements not shown, such as a retainer.

In the example of FIG. 10, each connection 205 includes a bolt 255, a flat washer 260, a lock washer 265, optional retainer 280, lock washer 285, flat washer 290, and two lock nuts 295, 300 forming a double lock nut. Bolt 255 extends through aligned apertures in shunt 195, primary seal 160, rim 111, and secondary seal 175. Bolt 255 extends through aligned apertures in shunt 195, primary seal 160, rim 111, and Washers 260, 265, 285, 290 and retainer 280 are placed on bolt 255 as shown. Washers 260, 265, 285, 290 may be metal washers. The order of flat washer 260 and lock washer 265 may be reversed. Similarly, the order of flat washer 290 and lock washer 285 may be reversed. In the example connection 205, flat washer 260 and lock washer 265 are interposed between bolt head 256 and shunt 195. Flat washer 290 and lock washer 285 are interposed between secondary seal 175 and lock nut 295. Shunt 195 may be in contact with primary seal 160 at connection 205 as shown. Connection 205 is secured by placing lock nuts 295, 300 on bolt 255 and tightening lock nut 300 against lock nut 295 with the required torque for the selected bolt size, preferably applied with a hydraulic torque wrench. With lock nut 300 tightened, all the elements between bolt head 256 and lock nut 300 are compressed together into a secure connection.

Returning to FIGS. 1 and 2, a method of assembling floating roof tank 100 may include providing storage tank 105 and floating roof 110. The method may include lowering floating roof 110 into storage tank 105. A part or all of the sealing system with lightning protection may be installed on floating roof 110 prior to lowering floating roof 110 into storage tank 105 or after lowering floating roof 110 into storage tank 105. In one example, shoe seal 130 may be installed inside storage tank 105 prior to lowering floating roof 110 into storage tank 105. After installing shoe seal 130 inside storage tank 105, floating roof 110 may be lowered into storage tank 105, and shoe hangers 135 may be connected between rim 111 of floating roof 110 and shoe seal 130. Primary seal 160 and shunts 195 may be attached to shoe seal 130 by making connections 200. Primary seal 160, shunts 195, and secondary seal 175 may be attached to rim 111 by making connections 205.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. A system comprising:

a storage tank having an inner side wall surface;

a floating roof having a rim, the floating roof disposed within the storage tank and separated from the inner side wall surface by an annular gap;

a shoe seal disposed inside the storage tank in sealing contact with the inner side wall surface;

a primary seal extending between the rim and the shoe seal, the primary seal having a first end proximate to the shoe seal and a second end proximate to the rim;

a secondary seal extending over the primary seal, the secondary seal having a first end in sealing contact with the inner side wall surface and a second end proximate to the rim;

a plurality of shunts extending over the primary seal and under the secondary seal, the plurality of shunts distributed along a perimeter of the floating roof, the plurality of shunts having first ends proximate to the shoe seal and second ends proximate to the rim;

a plurality of first connections attaching the first end of the primary seal and the first ends of the plurality of shunts to the shoe seal; and a plurality of second connections attaching the second end of the primary seal, the second end of the secondary seal, and the second ends of the plurality of shunts to the rim.

2. The system of claim 1, wherein the first end of the secondary seal includes a wiper seal.

3. The system of claim 1, wherein each of the plurality of shunts includes a flat strap conductor or a bare conductor with lugs made of electrically conductive material.

4. The system of claim 1, wherein each of the first connections includes one of a plurality of apertures formed in the shoe seal, one of a plurality of apertures formed in the first end of the primary seal, and an aperture formed in the first end of one of the shunts.

5. The system of claim 4, wherein each of the first connections comprises a first bolt inserted through the respective apertures at the first connection.

6. The system of claim 5, wherein each of the first connections comprises a first double lock nut placed on the first bolt and tightened with a required torque for a selected size of the first bolt, and wherein portions of the first end of the primary seal, the shoe seal, and the first end of one of the shunts are compressed between a head of the bolt and the first double lock nut.

7. The system of claim 6, wherein each of the first connections further comprises a first set of washers placed on the first bolt and interposed between the head of the first bolt and the shoe seal and a second set of washers placed on the bolt and interposed between the shunt and the first double lock nut, each of the first and second sets of washers comprising a flat washer and a lock washer.

8. The system of claim 1, wherein each of the second connections includes one of a plurality of apertures formed in the rim, one of a plurality of apertures formed in the second end of the primary seal, one of a plurality of apertures formed in the second end of the secondary seal, and an aperture formed in the second end of one of the shunts.

9. The system of claim 8, wherein each of the second connections comprises a second bolt inserted through the respective apertures at the second connection.

10. The system of claim 9, wherein each of the second connections comprises a second double lock nut placed on the second bolt and tightened with a required torque for a selected size of the second bolt, and wherein portions of the second end of the primary seal, the rim, the second end of the secondary seal, and the second end of one of the shunts are compressed between a head of the second bolt and the second double lock nut.

11. The system of claim 10, wherein each of the second connections further comprises a first set of washers placed on the second bolt and interposed between the head of the second bolt and the primary seal and a second set of washers placed on the second bolt and interposed between the secondary seal and the second double lock nut, each of the first and second sets of washers comprising a flat washer and a lock washer.

12. The system of claim 1, further comprising a plurality of shoe hangers attached between the shoe seal and the rim, each of the plurality of shoe hangers to apply a force to the shoe seal to maintain the sealing contact between the shoe seal and the inner side wall surface.

13. The system of claim 1, wherein a circumferential spacing between the plurality of shunts is approximately 3 meters.

14. A system comprising:

a primary seal having a first end with a plurality of first apertures and a second end with a plurality of second apertures;

a secondary seal extending over the primary seal and having a first end including a wiper seal and a second end with a plurality of apertures;

a plurality of shunts extending over the primary seal and under the secondary seal, each of the plurality of shunts having a first end with a first aperture and a second end with a second aperture;

a plurality of first connections engageable with the first apertures in the first end of the primary seal and the first apertures in the first ends of the plurality of shunts, the plurality of first connections to attach the plurality of shunts to the primary seal at spaced apart locations along the primary seal; and a plurality of second connections engageable with the second apertures in second end of the primary seal, the apertures in the second end of the secondary seal, and the second apertures in the second ends of the plurality of shunts, the plurality of second connections to attach the shunts to the primary seal and secondary seal at spaced apart locations along the primary seal and the secondary seal.

15. The system of claim 14, wherein each of the plurality of shunts includes a flat strap conductor or a bare conductor with lugs made of electrically conductive material.

16. The system of claim 14, wherein each of the first connections comprises a first bolt that is insertable through one of the first apertures of the primary seal that is aligned with the first aperture of one of the shunts, and wherein each of the first connections comprises a first double lock nut that is placeable on the first bolt, the first double lock nut to be tightened with a required torque for a selected size of the first bolt to secure the first connection.

17. The system of claim 16, wherein each of the first connections further comprises a first set of washers placeable on the first bolt and a second set of washers placeable on the first bolt, each of the first and second sets of washers comprising a flat washer and a lock washer.

18. The system of claim 14, wherein each of the second connections comprises a second bolt that is insertable through one of the second apertures of the primary seal that is aligned with the second aperture of one of the shunts and one of the apertures of the secondary seal, and wherein each of the second connections comprises a second double lock nut that is placeable on the second bolt, the second double lock nut to be tightened with a required torque for a selected size of the second bolt to secure the second connection.

19. The system of claim 18, wherein each of the second connections comprises a first set of washers placeable on the second bolt and a second set of washers placeable on the second bolt, each of the first and second sets of washers comprising a flat washer and a lock washer.

* * * * *